US006564437B2

(12) United States Patent
Meng et al.

(10) Patent No.: US 6,564,437 B2
(45) Date of Patent: May 20, 2003

(54) DOUBLE SIDED NEEDLED FIBER GLASS MAT FOR HIGH FLOW THERMOPLASTIC COMPOSITE

(75) Inventors: Jian Meng, Ross Township, PA (US); Thomas V. Thimons, Hampton Township, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 163 days.

(21) Appl. No.: 09/734,472

(22) Filed: Dec. 11, 2000

(65) Prior Publication Data

US 2001/0000500 A1 Apr. 26, 2001

Related U.S. Application Data

(62) Division of application No. 09/182,915, filed on Oct. 30, 1998, now Pat. No. 6,258,739.

(51) Int. Cl.[7] ..... D04H 1/46
(52) U.S. Cl. ..... 28/107; 28/111; 28/115
(58) Field of Search ..... 28/107, 109, 111, 28/113, 115, 110, 112, 114; 442/402; 65/62, 111, 112, 406, 17.3, 17.6

(56) References Cited

U.S. PATENT DOCUMENTS

| | | | | | |
|---|---|---|---|---|---|
| 3,817,820 | A | * | 6/1974 | Smith, II | 28/112 |
| 3,856,602 | A | * | 12/1974 | Colijn et al. | 28/115 |
| 4,132,821 | A | * | 1/1979 | Hiers et al. | 28/107 |
| 4,277,531 | A | | 7/1981 | Picone | 428/228 |
| 4,335,176 | A | | 6/1982 | Baumann | 428/228 |
| 4,390,582 | A | * | 6/1983 | Pickens et al. | 28/113 |
| 4,457,055 | A | * | 7/1984 | Ambrose et al. | 28/111 |
| 4,536,927 | A | * | 8/1985 | Feyerl et al. | 28/115 |
| 4,885,205 | A | | 12/1989 | Wahl et al. | 428/285 |
| 5,580,646 | A | | 12/1996 | Jansz et al. | 428/228 |
| 5,636,420 | A | * | 6/1997 | Jourde et al. | 28/111 |
| 5,753,062 | A | | 5/1998 | Jansz et al. | 156/148 |

* cited by examiner

*Primary Examiner*—Amy B. Vanatta
(74) *Attorney, Agent, or Firm*—Andrew C. Siminerio; Dennis G. Millman

(57) ABSTRACT

A fiber glass mat adapted to reinforce thermoplastic polymeric molding material is provided with improved flow properties in the molding process without sacrificing strength and without unduly increasing loft of the mat. The improvement is achieved by needling the mat from both sides with the number of needle punches per unit area on one side being greater than that on the opposite side.

7 Claims, No Drawings

DOUBLE SIDED NEEDLED FIBER GLASS MAT FOR HIGH FLOW THERMOPLASTIC COMPOSITE

This invention is a divisional of application Ser. No. 09/182,915, filed Oct. 30, 1998, now U.S. Pat. No. 6,258,739.

BACKGROUND OF THE INVENTION

The present invention involves improvements in fiber glass mats that are used as reinforcements in thermoplastic composite materials.

Composites of fiber glass reinforcements and thermoplastic matrix materials can be formed by various molding techniques such as compression molding or stamping. The resulting composites can be used in a wide variety of products where a combination of strength and light weight are desired.

The configuration and type of reinforcement significantly effect the physical characteristics of the composite, such as tensile strength, flexural strength, and impact performance. Preferred reinforcement configurations may vary considerably for different molding processes and molding conditions. One known method of varying the physical configuration of a mat is by needling. Needling has several effects on a mat that are beneficial for high flow thermoplastic laminating applications. These include consolidating the mat to enhance mat strength, modifying loft, and rupturing and opening fiber glass bundles to individual filaments. The rupturing and opening functions improve the ability of the glass fiber reinforcement to flow along with the polymeric matrix material when the laminate is molded. In other words, the fiber glass reinforcement has sufficient mobility to be displaced into features of the molded product during the molding process. This, in turn, improves the appearance of the molded composite products. However, known needling techniques are not able to achieve optimization of all of these factors in a single mat. Needling from only one side of a mat is good for strengthening the mat, but it is difficult to achieve sufficient opening of the mat for improved flow without over-punching the mat and sacrificing strength.

Needling a fiber glass mat is known to produce spikes of fibers protruding from the original surface of the mat. U.S. Pat. No. 4,335,176 (Baumann) discloses needling a fiber glass mat through its thickness from one side whereby one side of the mat has more fiber spikes than the other side. The differential is produced by the orientation of barbs on the needles. Because the mat is needled from one side, the number of needle punches is necessarily uniform throughout the mat. The patent discloses assembling two of these mats for lamination.

U.S. Pat. No. 4,885,205 (Wahl et al.) discloses symmetrically needling a mat from both sides so as to reduce needle penetration depth. The objective is to improve appearance of the laminate by reducing the height of the fiber spikes above the original mat surface due to the needling. The emphasis of the disclosure is on making the needling symmetrical on both sides, both in needle penetration depth and needle penetration density. While some improvements are possible with this approach, it has been found difficult to balance tensile strength with good appearance of the molded product using mats made by the method of this patent.

U.S. Pat. No. 5,580,646 (Jansz et al.) discloses needling a mat on both sides, wherein the needling depth or needle type differs from one side to the other. Needle punch density is the same on both sides. The asymmetric mats that are produced are intended to be laminated in pairs. When high flow properties are produced by this method, it has been found that loft is higher than desirable for some applications.

It would be desirable if certain properties of a fiber glass mat could be enhanced for improved thermoplastic composite molding performance with less compromise in other desirable properties as is incurred with prior art approaches.

SUMMARY OF THE INVENTION

It has now been found that a fiber glass mat intended for use in reinforcing thermoplastic composites can be provided with a surprisingly advantageous combination of properties by means of a novel needling configuration. The mats of the present invention have a unique combination of good strength, controlled loft, and an enhanced degree of openness for flow during molding. This combination of advantageous properties has been discovered to be attainable by needling the mat from both sides, wherein the needling density (i.e., the number of needle punches per area of mat surface) on one side of the mat differs from that on the other side. The amount of the needling density difference may vary depending upon the desired effect and the details of a particular mat construction and needling operation. Any appreciable difference may be significant, but generally significant advantages are observed when the needle punch density on one side exceeds that on the other side of the mat by more than 5 percent, preferably more than 10 percent. Particularly good results have been obtained by the inventors with preferred commercial mat embodiments when the needling density on one side of the mat is at least 20 percent greater than that on the opposite side of the mat. Optionally, further variations may be used in the needling parameters from one side to the other, such as the needle type and/or needle penetration depth, to achieve further refinements in the mat characteristics. It is particularly advantageous to vary the needling penetration depth in conjunction with the needling density difference. The combination of needling at a relatively deep penetration at relatively low density on one side and needling at a relatively low penetration at relatively high density on the opposite side has been found to be particularly advantageous in achieving improved openness of the mat structure without undue loss of strength.

After needling, the mat may be laminated with thermoplastic resin to form a stampable composite sheet in the usual manner. Unlike some of the prior art, it is not necessary to use two reinforcement mats with the present invention.

Other properties are generally sought after with fiber glass reinforcements including good permeability for impregnation by the thermoplastic matrix material and the ability to yield composite products with good surface smoothness and mechanical properties such as tensile, flexural and compressive strength, tensile and flexural modulus and stiffness. These desirable properties need not be sacrificed in order to attain the advantages of the present invention.

DETAILED DESCRIPTION OF THE PREFERRED EMBODIMENTS

The present invention involves fiber glass reinforcement mats, for which the general manufacturing techniques are well known in the art. The glass fibers used in the mats of the present invention are also those conventionally used in the art. The following description of the fiber forming and mat forming operations are merely examples of processes that may be used for these steps and are included for the sake of completeness of the disclosure of the best mode of carrying out the invention. Additional information regarding these conventional aspects of the invention may be found in K. Loewenstein, *The Manufacturing Technology of Continuous Glass Fibres*, 3rd Ed. (1993).

The mat is comprised of fibers of known glass compositions based upon oxides such as silica selectively modified with other oxide and non-oxide compounds. Useful glass fibers can be formed from any type of fiberizable glass composition known to those skilled in the art, and include those prepared from fiberizable glass compositions commonly known as "E-glass," "A-glass," "C-glass," "D-glass," "R-glass," "S-glass," as well as E-glass derivatives that are fluorine-free and/or boron-free. Most reinforcement mats comprise glass fibers formed from E-glass. Such compositions and methods of making glass filaments therefrom are well known to those skilled in the art and a more detailed description is not necessary. Further information may be found in Loewenstein (supra), pages 30–44, 47–60, 115–122, and 126–135, which are hereby incorporated by reference.

Commercially produced glass fibers generally have nominal filament diameters ranging from 5.0 to about 35.0 micrometers, and most commonly produced E-glass fibers have a nominal filament diameter of 9.0 to 30.0 micrometers. The present invention may employ any of the commercially available fibers suitable for fabricating in to mats. For further information regarding nominal filament diameters and designations of glass fibers, see Loewenstein (supra) at page 25, which is hereby incorporated by reference.

The glass fibers are conventionally coated on at least a portion of their surfaces with a sizing composition selected for compatibility with the polymeric thermoplastic matrix material. The sizing composition facilitates wet-out and wet-through of the matrix material upon the fiber strands and assists attaining desired physical properties in the composite. Examples of sizing compositions are disclosed in assignee's U.S. Pat. Nos. 3,997,306 and 4,305,742, which are hereby incorporated by reference. Another sizing composition used commercially comprises a polyepoxide such as EPON® 880 and a thermosetting polyester material such as RD-847A polyester resin in a ratio of about 1:1 to about 6:1 on a total weight basis as the polymeric film forming materials, and may also include PVP K-30 polyvinyl pyrrolidone, EMERY® 6717 partially amidated polyethylene imine lubricant, EMULPHOR EL-719 polyoxyethylated vegetable oil, IGEPAL CA-630 ethoxylated octylphenoxyethanol, PLURONIC™ F-108 polyoxypropylene-polyoxyethylene copolymer, SAG 10 anti-foaming material and A-174 functional organo silane coupling agent.

The sizing compositions used here should be compatible with thermoplastic matrix materials. Non-limiting examples of suitable polymeric film-forming materials usable in sizing composition which are compatible with a thermoplastic matrix material include thermoplastic vinyl acetate materials, thermoplastic polyesters, acrylic polymers, polyamides, polyolefins, thermoplastic polyurethanes, vinyl polymers, derivatives and mixtures thereof.

Useful acrylic polymers for use as the film-forming component of a sizing composition include polymers or copolymers of monomers such as acrylic acid; methacrylic acid; esters of these acids such as ethyl, propyl and butyl acrylates and methacrylates; polyglycidyl acrylates and methacrylates; acrylamides; acrylonitriles; and copolymers with unsaturated vinyl compounds such as styrene or vinyl acetate. A few examples of the many commercially available acrylic polymers suitable for this purpose include: FULATEX materials from H.B. Fuller Co. of St. Paul, Minn.; RHOPLEX acrylic emulsions from Rohm and Haas of Philadelphia, Pa.; and CARBOSET acrylic polymers from B.F. Goodrich Co. of Cleveland, Ohio.

Useful polyamides for use as the film-forming component of a sizing composition include the VERSAMID products which are commercially available from General Mills Chemicals, Inc. Suitable thermoplastic polyurethanes are condensation products of a polyisocyanate material and a hydroxyl-containing material such as polyol and include, for example, WITCOBOND® W-290H which is commercially available from Witco Chemical Corp. of Chicago, Ill. and RUCO 2011L which is commercially available from Ruco Polymer Corp. of Hicksville, N.Y.

Useful polyolefins for use as the film-forming component of a sizing composition include polypropylene and polyethylene materials such as the polypropylene emulsion RL-5440, which is commercially available from Sybron Chemicals of Birmingham, N.J., and Polyemulsion CHEMCOR 43C30, which is commercially available from Chemical Corp. of America.

Generally, the amount of polymeric film-forming material can be about 10 to about 90 weight percent of the sizing composition on a total solids basis, and is preferably about 60 to about 80 weight percent.

The sizing composition can additionally include one or more thermoplastic vinyl polymers, such as polyvinyl pyrrolidones, in an amount which does not detrimentally affect the compatibility of the polymeric film forming materials discussed above with the thermosetting matrix material, if present. Examples of suitable polyvinyl pyrrolidones include PVP K-15, PVP K-30, PVP K-60 and PVP K-90, each of which are commercially available from ISP Chemicals of Wayne, N.J. The thermoplastic vinyl polymer is preferably present in an amount of about 0.5 to about 10 weight percent of the sizing composition on a total solids basis.

The sizing composition preferably further comprises one or more glass fiber lubricants which are different from the polymeric film-forming materials discussed above. As used herein, the phrase "glass fiber lubricants which are different from the polymeric film-forming materials" means that while the glass fiber lubricants may have film-forming properties, the glass fiber lubricant(s) selected for a particular sizing composition are chemically different from the polymeric film-forming materials included in the same coating composition.

Useful glass fiber lubricants include cationic, non-ionic or anionic lubricants and mixtures thereof. Generally, the amount of fiber lubricant can be about 1 to about 25 weight percent of the sizing composition on a total solids basis. Some examples of the many known fiber lubricants include amine salts of fatty acids (which can, for example, include a fatty acid moiety having 12 to 22 carbon atoms and/or tertiary amines having alkyl groups of 1 to 22 atoms attached to the nitrogen atom), alkyl imidazoline derivatives (such as can be formed by the reaction of fatty acids with polyalkylene polyamines), acid solubilized fatty acid amides (for example, saturated or unsaturated fatty acid amides having acid groups of 4 to 24 carbon atoms such as stearic amide), condensates of a fatty acid and polyethylene imine and amide substituted polyethylene imines, such as EMERY® 6717, a partially amidated polyethylene imine commercially available from Henkel Corporation. A specific useful alkyl imidazoline derivative is CATION X, which is commercially available from Rhone Poulenc of Princeton, N.J. Other useful lubricants include RD-1135B epoxidized polyester which is commercially available from Borden Chemical of Louisville, Ky., CIRRASOL 185A fatty acid amide, KETJENLUBE 522 partially carboxylated polyester which is commercially available from Akzo Chemicals, Inc. Of Chicago, Ill. and PROTOLUBE HD high density polyethylene emulsion which is commercially available from Sybron Chemicals of Birmingham, N.J.

The sizing composition preferably comprises one or more coupling agents selected from the group consisting of organo silane coupling agents, transition metal coupling agents (such as titanium, zirconium and chromium coupling agents), amino-containing Werner coupling agents and mixtures thereof. These coupling agents typically have dual functionality. Each metal or silicon atom has attached to it groups that can react or compatibilize with the glass fiber surface as well as with the components of the sizing composition. As used herein, the term "compatibilize" with respect to coupling agents means that the groups are chemically attracted to, but not necessarily reacted with, the glass fiber surface and/or the components of the sizing composition, for example by polar, wetting or solvation forces.

Examples of suitable organo silane coupling agents include Z-6040 gamma-glycidoxypropyltrimethoxysilane (commercially available from Dow Corning), A-187 gamma-glycidoxypropyltrimethoxysilane, A-174 gamma-methacryloxypropyltrimethoxysilane and A-1100 gamma-aminopropyltriethoxysilane silane coupling agents (each of which are commercially available from OSi Specialties, Inc. of Tarrytown, N.Y.).

The amount of coupling agent can be 1 to about 10 weight percent of the sizing composition on a total solids basis. The organo silane coupling agent can be at least partially hydrolyzed with water prior to application to the glass fibers.

Crosslinking materials can also be included in the sizing composition. Examples of known suitable crosslinkers include melamine formaldehyde and polyamides such as the VERSAMID products commercially available from General Mills Chemicals, Inc. The amount of crosslinker typically ranges from about 1 to about 5 weight percent of the sizing composition on a total solids basis.

The sizing composition may include one or more emulsifying agents for stabilizing the sizing composition in water. Examples of suitable emulsifying agents or surfactants include polyoxyalkylene block copolymers (such as PLURONIC™ F-108 polyoxypropylene-polyoxyethylene copolymer which is commercially available from BASF Corporation of Parsippany, N.J.), ethoxylated alkyl phenols (such as IGEPAL CA-630 ethoxylated octylphenoxyethanol which is commercially available from GAF Corporation of Wayne, N.J.), polyoxyethylene octylphenyl glycol ethers, ethylene oxide derivatives of sorbitol esters and polyoxyethylated vegetable oils (such as EMULPHOR EL-719, which is commercially available from GAF Corp.). Generally, the amount of emulsifying agent can be about 1 to about 30 weight percent of the sizing composition on a total solids basis.

The sizing composition can also include one or more aqueous dispersible or soluble plasticizers to improve flexibility. Examples of suitable non-aqueous-based plasticizers which are aqueous dispersible plasticizers include phthalates, such as di-n-butyl phthalate; trimellitates, such as trioctyl trimellitate; and adipates, such as dioctyl adipate. The amount of plasticizer is preferably less than about 5 weight percent of the sizing composition on a total solids basis.

Fungicides, bactericides and anti-foaming materials and organic and/or inorganic acids or bases in an amount sufficient to provide the aqueous sizing composition with a pH of about 2 to about 10 can also be included in the sizing composition. Water (preferably deionized) is included in the sizing composition in an amount sufficient to facilitate application of a generally uniform coating upon the strand. The weight percentage of solids of the sizing composition generally can be about 5 to about 20 weight percent.

A particular sizing composition for glass fiber strands for reinforcing a thermoplastic matrix material includes EPON® 880 epoxy resin and RD-847-A polyester resin as the polymeric film forming materials, PVP K-30 polyvinyl pyrrolidone, EMERY® 6717 partially amidated polyethylene imine lubricant, EMULPHOR EL-719 polyoxyethylated vegetable oil, IGEPAL CA-630 ethoxylated octylphenoxyethanol, PLURONIC™ F-108 polyoxypropylene-polyoxyethylene copolymer, SAG 10 anti-foaming material and A-174 and Z-6040 functional organo silane coupling agents.

The sizing can be applied in many ways, for example by contacting the filaments with a static or dynamic applicator, such as a roller or belt applicator, spraying or other means. For a discussion of suitable applicators, see Loewenstein (supra) at pages 165–172, which is hereby incorporated by reference. Sized filaments may be gathered together into strands. The number of filaments per strand can range from about 100 to about 15,000, more typically about 200 to about 7000. For more information regarding glass fiber strand designations, see Loewenstein (supra) at page 27, which is hereby incorporated by reference.

The sized strands may be dried at room temperature or at elevated temperatures to remove excess moisture and to cure any curable sizing or secondary coating composition that may be present. Drying of glass fiber forming packages or cakes is discussed in detail in Loewenstein (supra) at pages 219–222, which is hereby incorporated by reference. The sizing is typically present on the filaments in an amount ranging from about 0.3 percent to about 1.5 percent by weight after drying.

Although not a preferred practice for the present invention, a secondary coating may be applied to the strands. The secondary coating composition is preferably aqueous-based and may include components similar to the sizing compositions discussed above. The secondary coating composition may be applied to at least a portion of the surface of the strands in an amount effective to coat or impregnate the portion of the strands. The secondary coating can be conventionally applied by dipping the strand in a bath containing the composition, by spraying the composition upon the strand or by contacting the strand with a static or dynamic applicator such as a roller or belt applicator, for example. The coated strand can be passed through a die to remove excess coating from the strand and/or dried as discussed above for a time sufficient to at least partially dry and cure the secondary coating. After drying, it is a common practice for glass fiber intended for mats to be gathered together into roving packages by winding together several generally parallel strands.

Preferably the mats of the present invention are formed from strands which have been chopped into discontinuous lengths. Commercially available choppers may be used, such as Model 90 chopper from Finn and Fram, Inc. Useful apparatus and processes for forming a layer of chopped strands is disclosed in Loewenstein (supra) at pages 293–303, which are hereby incorporated by reference.

An antistatic agent, for example an amine, amide or quaternary salt such as soyadimethyl and ethylammonium ethosulfate, can be applied to the filaments or strands prior to deposition upon the conveyor, if desired.

The mat can be formed using a mat forming apparatus comprising one or more fiber strand supplies, as are known in the art. Preferably, the strand supply comprises a plurality of forming or supply packages mounted upon a creel. Conventional creels suitable for use in the present invention are shown in Loewenstein (supra) at page 315, which is hereby incorporated by reference. The supply packages can be wound such that the strand can be withdrawn from the inside of the supply package or from the outside of the supply package.

The mat can be combined with minor amounts of unidirectional glass fibers, thermoplastic fiber and/or fabrics. The purpose for these additional fibers is to provide temporary strength to the mat during manufacturing prior to laminating. The unidirectional strands can be fed from a creel having a plurality of supply packages to align the unidirectional strands in generally parallel and coplanar alignment. The unidirectional strands and/or fabric can be positioned between layers of the mat or adjacent the top side or bottom side of the mat, as desired. The mat of the present invention may contain fibers that are exclusively glass fibers, but in some cases it is preferred to include, in addition to the glass fibers, a minor amount of fibers that are other than glass fibers ("non-glass fibers"). The non-glass fibers may be blended with the glass fibers in the mat or they may be in the form of a carrier web (e.g., a non-woven fabric) upon which the fiber glass mat is deposited. In some cases the mat may be heated to a temperature at which the non-glass fibers at least partially fuse, thereby binding the mat structure together. A wide variety of commercially available fibers are suitable for this purpose, including synthetic polymers such as polyamides, polyesters, acrylics, polyolefins, polyurethanes, vinyl polymers, derivatives and mixtures thereof.

Non-limiting examples polyamide fibers useful as the supplemental non-glass fiber content of the mat include nylon fibers such as nylon 6 (a polymer of caprolactam which has a melting point of about 223° C.) and nylon 6,6 (a condensation product of adipic acid and hexamethylenediamine which has a melting point of about 264° C.). Suitable nylons are commercially available from E.I. duPont de Nemours and Company of Wilmington, Del., and BASF Corp. of Parsippany, N.J. Other useful polyamides include aramids such as KEVLAR, which is available from DuPont.

Thermoplastic polyester fibers useful as the supplemental non-glass fiber in the present invention include those composed of at least 85 percent by weight of an ester of a dihydric alcohol and terephthalic acid, such as polyethylene terephthalate, which has a melting point of about 265° C. according to *Hawley's Condensed Chemical Dictionary* (12th Ed. 1993) at page 934. Examples include DACRON which is available from DuPont, and FORTREL which is available from Hoechst Celanese Corp. of Summit, N.J.

Other fibers which are useful as the supplemental non-glass fiber in the present invention include those formed from acrylic polymers such as polyacrylonitriles having at least about 35 percent by weight acrylonitrile units, and preferably at least about 85 percent by weight, which can be copolymerized with other vinyl monomers such as vinyl acetate, vinyl chloride, styrene, vinylpyridine, acrylic esters or acrylamide.

Useful polyolefin fibers are generally composed of at least 85 percent by weight of ethylene, propylene, or other olefins.

Fibers formed from vinyl polymers which are useful in the present invention can be formed from polyvinyl chloride, polyvinylidene chloride, polytetrafluoroethylene, and polyvinyl alcohol.

Further examples of thermoplastic fiberizable materials which are useful in the present invention are fiberizable polyimides, polyether sulfones, polyphenyl sulfones; polyether ketones, polyphenylene oxides, polyphenylene sulfides and polyacetals.

Other supplemental non-glass fibers that may be present in the mat include natural fibers such as cotton or jute, which may serve as low-cost fillers, and inorganic fibers such as polycrystalline fibers, ceramics including silicon carbide, and carbon or graphite. It should be apparent that the non-glass fibers may include combinations of the fibers described above, as well as fibers formed from blends or copolymers of the materials described above.

The mat can be treated or coated with an adhesive or polymeric binder material to promote consolidation of the mat prior to or after entanglement, although use of a binder is not preferred. Non-limiting examples of useful polymeric binders include polyvinyl acetate, polyesters and polypropylene. Suitable polymeric binders can be in the form of a powder, fiber or emulsion, as desired. The binders are consolidated with the mat by the application of heat and pressure, such as by passing the mat between heated calendering rolls.

After the mat has been formed, it is subjected to a needling process. The glass filaments and glass fiber strands of the mat (as well as any supplemental fibers) are intermeshed by subjecting the mat to a needling process. The needling can be accomplished using a conventional needling apparatus as used in the fiber glass reinforcement industry, wherein the mat is passed between spaced needling boards. An example of such an apparatus is disclosed in assignee's U.S. Pat. No. 4,277,531 (Picone), which is hereby incorporated by reference. An example of one suitable needling machine is Model NL 9 which is commercially available from Textilmaschinenfabrik Dr. Ernest Fehrer AG of Germany. The mat in the present invention is needled from both sides either by employing a single-sided needling apparatus twice or by using a double sided needler. A particular feature of the present invention is that the needling on one side of the mat is different from that on the opposite side, as will be set forth more fully below.

In the needling operation, a plurality of spaced needles are used to entangle or intertwine the monofilaments and strands of the mat to impart mechanical strength and integrity to the mat. The needling operation may use conventional needles that are constructed with barbs that angle downwardly toward the needle tips, whereby fibers in the mat are entangled as the needles pass downwardly through the mat. On the upward stroke, this needle type generally releases fibers. Although needles with downwardly pointed barbs are preferred, the use of reverse barb needles (i.e., upwardly pointed) is not precluded in the present invention. Although the present invention is not limited to a particular needle configuration, the invention has been successfully carried out with a conventional needle design having three tiers of barb clusters spaced apart along the shaft of the needle, with three barbs in each cluster arranged around the shaft. Preferably, the gauge of the needle ranges from about 32 to about 19 gauge, with a combination of 25 and 32 gauge needles being preferred.

As used herein, the terms "horizontal" or "horizontally" refer to a plane generally parallel to the major plane of the mat, which is typically parallel to the ground. As used herein, the terms "vertical" or "vertically," "downwardly," and "upwardly" refer to a direction generally normal to "horizontal." It should be understood that these specific directional terms are used to describe the needling operation for convenience, reflecting the usual orientation of the needling apparatus, and for defining the directions relative to each other, but that these orientations are not limitations on the process.

On the downward needling stroke, the needles of the upper needle board pass through the mat and into generally cylindrical orifices in a backer board supporting the mat. Depending upon the needling depth, one or more of the tiers of barbs pass entirely through the mat and into the backer board orifices. For the purposes of the present invention, when a three-tier needle design is used, it is preferred that at least two tiers of barbs pass through and beyond the mat. Most preferably, all three barb tiers pass through the mat. The distance that the needles pass beyond the mat and into the orifices in the backer board is reported as the "needling depth."

During upward withdrawal stroke, after the needles exit the mat, they are passed through a plurality of generally cylindrical orifices in a metal stripper plate supported above the mat during the needling process. The filaments and strands are thus pulled from the barb by the stripper plate, and the mat then is advanced in the horizontal direction after the downward and upward stroke of the needle.

The needle board may be reciprocated with a frequency of about 80 to about 3000 strokes per minute (a stroke being a complete downward and upward motion). The needler is provided with rolls to propel the mat in the horizontal direction during needling. At slower frequencies the advancement occurs intermittently in the interval between punches of the needles. At faster frequencies, the advancement approaches a continuous motion.

The length of the needle and the depth of the penetration of the needle through the mat during its passage through the needler, and thus the extent to which the filaments and strands are entangled in a generally vertical direction through the mat affect the impact strength of a composite incorporating the mat as reinforcement.

The depth of penetration of the needles into the orifices of the backer plate may range from about 2 to about 30 millimeters. In a typical needling process, the mat entering the needler may have an overall average thickness of about 2 to about 100 millimeters. After passage throughout the needler, the mat can have a compressed overall average thickness of about 2.5 to about 25 millimeters (about 0.1 to about 1 inches). The needling process is described in further detail in assignee's U.S. Pat. No. 4,335,176 (Bauman), which is hereby incorporated by reference. The weight of a mat after needling typically ranges from about 200 to about 2000 grams per square meter.

The density of needle punches in a mat is another variable that affects the reinforcement properties of the mat. In general, needle punch density may range from about 6 to about 100 punches per square centimeter (about 40 to about 600 punches per square inch). A particularly advantageous feature of the present invention is that the punch density varies from one side to the other of the mat. The punch density difference may vary in accordance with the properties desired. In theory there is no minimum difference, but appreciable benefits are generally realized when the punch density on one side is at least 5 percent greater on one side than the other, preferably at least 10 percent greater. Particularly advantageous results have been attained with preferred embodiments of mats with a density difference in the range of 20 to 40 percent. Theoretically, no upper limit has been determined, but mechanical limitations may make it difficult to attain differences greater than about 50 percent with a conventional needling apparatus.

The completed mat can be used to reinforce a polymeric matrix material to form a polymeric composite by any method known in the art, for example by compression molding. The selection of the thermoplastic material is not part of this invention; any of the suitable thermoplastic materials employed in the reinforced composite industry may be used. General types of polymeric thermoplastic matrix materials used for this purpose include polyolefins, polyamides, thermoplastic polyurethanes, thermoplastic polyesters, acrylic polymers, vinyl polymers, derivatives and mixtures thereof.

Non-limiting examples of useful polyolefins include polyethylene, extended-chain polyethylene, polypropylene, polybutene, polyisoprene, and polypentene, polymethyl pentene, polytetrafluoroethylene and neoprene.

Useful polyamides include nylons such as nylon 6 (a polymer of caprolactam), nylon 12 (which can be made from butadiene), nylon 66 (a condensation product of adipic acid and hexamethylenediamine), nylon 10 and nylon 12 such as are commercially available from DuPont. Other examples of useful polyamides include polyhexamethylene adipamide and aramids such as KEVLAR, which is commercially available from DuPont.

Suitable thermoplastic polyurethanes are condensation products of a polyisocyanate material and a hydroxyl-containing material such as polyol and include, for example, ESTANE and TEXIN polyurethanes which are commercially available from B.F. Goodrich of Toledo, Ohio and Bayer, respectively.

Thermoplastic polyesters useful in the present invention include polyethylene terephthalate and polybutylene terephthalate. Acrylic polymers useful in the present invention include polyacrylates, polyacrylamides and polyacrylonitriles such as nitrile rubber.

Useful vinyl polymers include polyvinyl chloride, polyvinylidene chloride, polyvinyl fluoride, polyvinylidene fluoride, ethylene vinyl acetate copolymers, such as ELVAX which is commercially available from DuPont, and polystyrenes.

Thermoplastic elastomeric materials useful as matrix materials in the present invention include styrene-butadiene rubbers, styrene-acrylontrile copolymers such as LUSTRAN, which is commercially available from Monsanto of St. Louis, Mo., styrene-butadiene-styrene copolymers and acrylonitrile-butadiene-styrene copolymers, such as CYCOLAC or BLENDEX, which are commercially available from GE Plastics of Pittsfield, Mass.

Further examples of useful thermoplastic materials include polyimides, polyether sulfones, polyphenyl sulfones, polyetherketones, polyphenylene oxides, polyphenylene sulfides, polyacetals, polyvinyl chlorides and polycarbonates. Also included as suitable thermoplastic materials are any of the above thermoplastics which are modified by an unsaturated monomer.

Other components which can be included with the polymeric matrix material and reinforcing mat in the composite are, for example, colorants or pigments, lubricants or process aids, ultraviolet light (UV) stabilizers, antioxidants, other fillers, and extenders.

The mat and polymeric matrix material can be formed into a composite by a variety of methods that may vary in accordance with the type of polymeric matrix material used and other factors. Thermoplastic composites can be formed by first assembling a laminate of the mat and thermoplastic matrix material and then compression molding or stamping the laminate. To form the laminate, the thermoplastic matrix material can be impregnated into the mat, and then the impregnated mat can be heated in a oven such as a conventional continuous oven at a temperature of about 190° C. to about 300° C. for about 7 minutes. The laminate can be transferred to a mold and heated under pressure to a temperature which may vary with the resin selected. For example, for polypropylene, the molding temperature can be about 65° C. The pressure for forming such a laminate can be about 14 megapascals. One skilled in the art would understand that the laminating and molding temperatures and pressure can vary in accordance with the dimensions and structure of the composite to be formed and the particular thermoplastic matrix material.

A method according to the present invention for making a mat adapted to reinforce a polymeric matrix material entails impregnating with a thermoplastic matrix material at least a portion of a mat that has been asymmetrically needled as described above. The thermoplastic matrix material is heated to a temperature sufficient to permeate the mat and is cooled to ambient temperature to provide a reinforced thermoplastic composite. This composite may subsequently be shaped by stamping or other molding processes as are known in the art.

The following is an example of a mat made in accordance with the present invention which is compared for performance properties with a commercially available mat which is believed to have been made by a uniform, double sided needling method as disclosed in U.S. Pat. No. 4,885,205 (Wahl et al.).

EXAMPLE 1

A mat was made from chopped fiber glass strand fed from forming packages in a conventional mat forming machine as described above. Long blade chopping was used to produce chopped strand of about 2 inches (5.08 centimeters) in length. The chopped strand was laid onto a carrier of non-woven polypropylene fabric. The mat was needled on the top side (opposite the carrier) as follows:

Eleven rows of 32 gauge felting needles on the feed side.

Twenty-seven rows of 25 gauge felting needles on the exit side.

Needling Density: 42 punches/cm$^2$ (270 punches/in$^2$).

Needling Depth: 11.43 millimeters (0.45 inch).

Needling conditions on the bottom side were as follows:

Eleven rows of 32 gauge felting needles on the feed side.

Twenty-seven rows of 25 gauge felting needles on the exit side).

Needling Density: 57 punches/cm$^2$ (342 punches/in$^2$).

Needling Depth: 10.16 millimeters (0.40 inch).

The needled mat had the following physical characteristics: mat weight of 83.63 grams per square foot (average of eight one square foot samples), loft of 6.35 millimeters (average of eight samples), tensile strength in the machine direction of 37.9 newtons (average of ten samples), and tensile strength in the transverse direction of 24.5 newtons (average of ten samples). Mat loft was measured as the height of the mat when a 2.25 kilogram weight was placed on a one square foot area of the mat. Tensile strength was measured with a 3 inch (7.6 centimeters) by 9 inch (22.9 centimeters) specimen drawn in its long dimension with a Chatillon Force Measurement Tester, Model UTSM with a 6.5 inch span.

Comparative Test

The laminate performance of the mat of Example 1 was compared with a comparable commercially available mat from BASF identified with product code B100F40. The comparative commercial mat is believed to be needled from both sides, with symmetrical needling on both sides as in the process described in U.S. Pat. No. 4,885,205. Composite laminates were made from Example 1 mats and the comparative mats with the same construction and with the same laminating process steps. Each laminate was an alternating sandwich of two mats and three sheets of polypropylene from Borealis Industries AB. Each composite laminate was subjected to performance tests with the following results:

EXAMPLE 1

| | | Comparative |
|---|---|---|
| Glass Content, % (DIN/EN 60) | 38.8 | 39.0 |
| Density, g/cm$^3$ (DIN 53479) | 1.2 | 1.23 |
| Tensile Strength, MPa (psi) (DIN/EN 61) | 92.8 (13456) | 84 (12200) |
| Tensile Modulus, GPa (ksi) (DIN/EN 61) | 6.7 (966) | 5.8 (846) |
| Tensile Elongation, % (DIN/EN 61) | 2.0 | 2.4 |
| Flexural Strength, MPa (psi) (DIN 53457) | 146 (21170) | 149 (21692) |
| Flexural Modulus, GPa (ksi) (DIN 53457) | 5.6 (811) | 5.5 (792) |
| Impact Resistance, KJ/m$^2$ (ft-lb/in$^2$), (Flatwise Charpy - DIN 53453) | 83 (39) | 72 (34) |
| Rib Strength, MPa (ksi) | 117 (17.0) | 85 (12.3) |
| Rib Fill, Tip, % | 30.4 | 29.7 |
| Rib Fill, Tip/Base, % | 78.0 | 72.7 |
| Viscosity, Megapoise | 55 | 55 |
| Laminate Loft, mm (in) | 19.1 (0.75) | 17.8 (0.70) |

Rib strength, rib fill, and rib fill ratio tests were performed on a regular 12.5 inch by 12.5 inch plaque molding machine. The plaque included a rib 1.5 inch tall and 0.125 inch thick extending perpendicularly from the plane of the plaque running down the center of the full 12.5 inch length of the plaque. Four rib plaques were molded for each trial. After molding, the plaques were tested for flexural strength in accordance with ASTM D790, the results of which are reported above as "rib strength." Then the ribs were cut from each plaque and subjected to further testing. Each rib was then cut longitudinally into three 0.5 inch strips representing the distal edge of the rib (the "tip"), the center of the rib, and the base of the rib (closest to the main plane of the plaque). The weight percentage of glass in each of the strips was determined by resin burn-off. The glass content of the tip strip is reported above as "rib fill in tip." Also reported above is the ratio of the glass content in the tip strip to that in the base rib strip ("rib fill, tip/base"). The higher rib strength, rib fill in tip, and tip/base ratio values for Example 1 compared to the commercial mat demonstrate the improved flow achieved with the mat of the present invention.

Other variations and modifications as are known to those of skill in the art may be resorted to within the scope of the invention as defined by the following claims.

What is claimed is:

1. A method of making a mat comprised of fiber glass adapted to reinforce a polymeric matrix material, the method comprising supplying to a needling station a mat comprising fiber glass having a first major surface and a second major surface, performing a first needling operation on the mat from the first major surface at a first density of needle punches per unit area, and performing a second needling operation on the mat from the second major surface at a second density of needle punches per unit area greater than said first density.

2. The method of claim 1 wherein said first needling operation and second needling operation are performed substantially simultaneously.

3. The method of claim 1 wherein said first needling operation and second needling operation are performed substantially sequentially.

4. The method of claim 1 wherein the needle construction of at least some of the needles used in the first needling operation are different in construction from the needles used in the second needling operation.

5. The method of claim 1 wherein the second density is at least 25 percent greater than the first density.

6. The method of claim 1 wherein in the first needling operation the needles are passed through the mat a distance different from that in the second needling operation.

7. The method of claim 6 wherein the distance of needle penetration in the first needling operation is greater than that in the second needling operation.

* * * * *